US005687603A

United States Patent [19]

Coppenolle

[11] Patent Number: 5,687,603

[45] Date of Patent: Nov. 18, 1997

[54] STRIP SIDE-GUIDES

[75] Inventor: Vincent Van Coppenolle, Eeklo, Belgium

[73] Assignee: Sidmar, N.V., Gent, Belgium

[21] Appl. No.: 567,309

[22] Filed: Dec. 5, 1995

[30] Foreign Application Priority Data

Dec. 6, 1994 [EP] European Pat. Off. ..... 94870191

[51] Int. Cl.[6] ..... B21B 39/20; B21D 43/16

[52] U.S. Cl. ..... 72/250; 72/251; 72/428

[58] Field of Search ..... 72/250, 251, 428; 198/836.3, 836.4

[56] References Cited

U.S. PATENT DOCUMENTS

| | | | |
|---|---|---|---|
| 3,461,707 | 8/1969 | Maltby | 72/250 |
| 4,400,963 | 8/1983 | Epps | 72/250 |
| 4,442,690 | 4/1984 | Hirschmanner et al. | 72/128 |
| 4,945,746 | 8/1990 | Jakimowicz et al. | 72/251 |

FOREIGN PATENT DOCUMENTS

| | | | |
|---|---|---|---|
| 1427923 | 1/1969 | Germany | B21B 39/14 |
| 48-32502 | 10/1973 | Japan | B21B 39/34 |
| 4-84615 | 3/1992 | Japan | B21B 39/14 |
| 2031771 | 4/1980 | United Kingdom | B21B 39/14 |

*Primary Examiner*—Lowell A. Larson
*Assistant Examiner*—Rodney Butler
*Attorney, Agent, or Firm*—Sheridan Ross P.C.

[57] ABSTRACT

Side guides intended for rolling mills in the metallurgical industry characterized in that these side-guides are divided in a succession of segments which are placed in an alternation of a first segment (11) of a substantially rectangular shape and having a width allowing its insertion between two successive rollers (2) and of a second segment (12) intended to be placed above a corresponding roller (2) of which the lower end is of substantially semicircular shape.

2 Claims, 2 Drawing Sheets

STRIP SIDE-GUIDES

The present invention is related to side-guides which are used in rolling mills in the metallurgical industry and especially for side-guides intended for steel strips at the entrance side of the coiler.

BACKGROUND INFORMATION

The finishing section in the rolling mills is intended to provide steel strips of required strip thickness (usually between 1.25 mm and 12.7 mm for hot rolling mills) before undergoing a coiling operation.

The strips are conveyed to the coiler by means of a succession of spaced rollers forming a so-called "roller table".

The entrance side of the coiler is equipped with a pair of side-guides for the strip in order to prevent the strip from leaving the roller table.

The side-guide is usually a plate of mild steel provided with substantially semicircular slots, at regularly spaced spots corresponding to the spaced rollers.

The friction between the moving strips and these side-guides causes a considerable wear of said side-guides and wear lines appear along the side-guides which require these side-guides be removed and repaired or replaced.

AIMS OF THE PRESENT INVENTION

The present invention aims at improved strip side-guides having an increased overall life-span compared to conventional side-guides, which are easily reconditioned for further operation of the equipment and which can be handled more efficiently than conventional side-guides.

BRIEF DESCRIPTION OF THE PRIOR ART

GB-A-2031771 (Hoverdale Engineering) describes rolling mill guides for guiding strips being rolled as they pass between rolling mill stands.

The object of the invention is to provide a mill guide with an exceptionally wear-resistant surface in a practicable and cost-effective manner, and which, moreover, is replaceable when necessary without replacement of the mill guide as a whole.

Accordingly, in a strip rolling mill the strip while being rolled is guided between mill stands on a guide surface provided by a plurality of spaced ceramic pads mounted on the mill guide.

An arrangement is provided in which the mill guide can be turned through 180° C. when the pads in one pair of holders are worn, thereby bringing the pads of the other pair into use.

The rolling mill is of conventional form namely they are made of one continuous piece provided with arcuate cut-outs. The provision of ceramic pads means an increase of costs and the inversion of pads by turning through 180° C. means a disassembling from the side guides.

DE-A-1427923 (KLÖCKNER-WERKE) also describes conventional side-guides which are provided with central means allowing a vertical movement of the side-guides while the strip is moved.

Worn-out side-guides will necessarily undergo a complete disassembling and said operation will be made difficult by the necessity to first dismount the control means of the side-guides. There is no provision of specific means in said document for replacing guide members which are worn.

Derwent Japanese Patents Report Section Ch, Week 7341, Derwent Publications Ltd., London, GB; Class M21, AN 73-61680U (41) (JP-B-48 032 502 (HITACHI) Oct. 6, 1973) describes an inlet guide which comprises several pairs of lateral guide members spaced along the opposite ends of the travel path of the strip, being led to the space between the rolls and adapted to contact and confine the opposite ends of the strip entering the roll stand. It also comprises several press-rolls disposed at points spaced along the strip path and located intermediate adjacent lateral guide members, the rotation axes of the press rolls extending transverse to the direction of advance of the strip. The lateral guide members in each pair are adapted to move laterally toward and away from each other by a suitable actuating mechanism. The inlet guide eliminates lateral displacement of the strip at the roll stand inlet and is intended to assure smooth and effective passage of the strip between the rolls.

According to Patent Abstracts of Japan, volume 16, no. 302 (M-1275) Jul. 3, 1992 (JP-A-04 084 615 (Kawasaki Steel) Mar. 17, 1992), the style of the coil is improved by detecting the change value of the sheet width from the center line of a steel sheet and moving guide plates in a transverse direction according to the detected value only during the passage of the steel sheet position of the maximum value when the maximum value is larger than the opening degree of the divided side-guide plates.

The side-guide plates are disposed in parallel on the right and left and are divided in the progressing direction of the steel sheet (thus, horizontally). The respective divided side-guide plates are constituted in such a manner that these plates can be moved respectively independently in the transverse direction. The change value of the sheet width from the center line of the steel sheet is then detected. The guide plates are moved in the transverse direction according to the detected value only during the passage of the steel position of the maximum value when the maximum value of the change value is larger than the opening degree of the divided side-guide plates. The deviation of the steel sheet in its transverse direction is drastically decreased in such a manner and the style of the coil when the steel sheet is coiled is improved.

The above-mentioned Japanese publication is not related to coiler and a full length disassembling of the side-guides or divisions of side-guides is necessary to replace the said side-guides.

SUMMARY OF THE INVENTION

The side-guides according to the present invention are divided in a succession of segments which are placed in an alternation of a first segment of a substantially rectangular shape and having a width allowing its insertion between two successive rollers and of a second segment placed above a corresponding roller, of which the lower end is of substantially semicircular shape to accommodate the roller.

In accordance with a preferred embodiment of the present invention, the segments between rollers are slightly offset compared to the vertical plane formed by the segments above the rollers, the spacing between two opposite segments which are placed between the rollers being smaller than the spacing between two opposite segments placed above the rollers so that the segments between the rollers undergo most of the wear.

At least, the segments between the rollers are vertically adjustable in such a manner that when the friction spot shows substantial wear, a vertical movement requiring no disassembling of the equipment allows further operation of the equipment which, of course, multiplies the term for renewing, compared to conventional equipment.

A preferred embodiment in accordance with the present invention will be described with reference to the attached drawings.

DETAILED DESCRIPTION OF THE PREFERRED EMBODIMENTS

Figure 1:
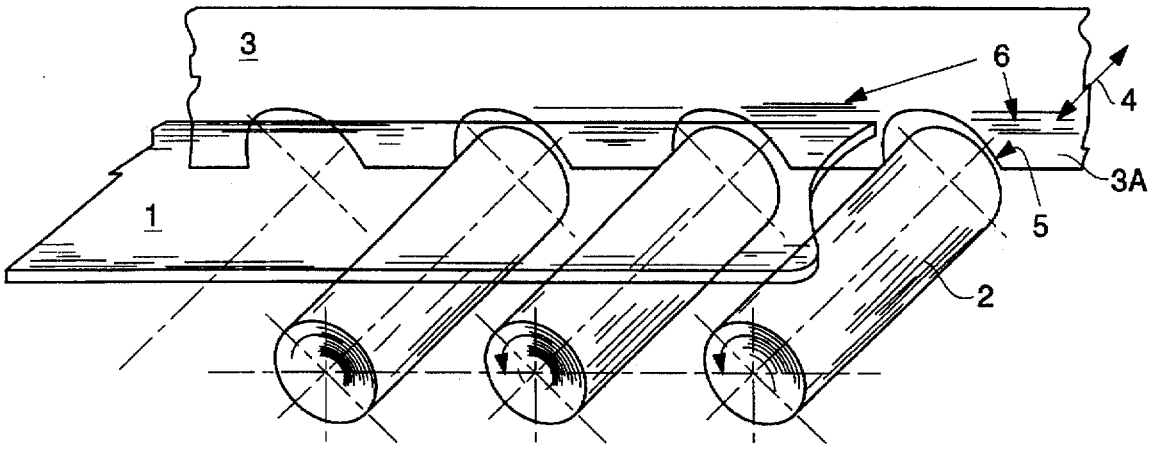
Fig 1 PRIOR ART
FIG. 1 is a schematic perspective view of a "roller table" in which only one side-guide for a steel strip before it enters the coffer is shown, said side-guide is made in accordance with the state of the art.

FIG. 1 shows a steel strip 1 which is conveyed onto a series of transportation rollers 2 towards the entry of a coiler (not represented).

In order to prevent the strip 1 from leaving the series of rollers 2 (which are usually qualified as a "roller table"), a pair of side-guides 3 are disposed above the rollers on each side of the path intended for the strip 1. These side-guides of which only one is shown in FIG. 1 are made of a plate of mild steel 3 provided with substantially semicircular slots 5 to accommodate the succession of rollers 2. These guides 3 can either be movable (as indicated by arrow 4) according to the strip width or can be fixed.

The contact between the moving strip 1 and the side-guides 3 marks a line of wear at the friction spot. The wear, if the side-guides 3 are not renewed or repaired on time, can even cause the lower part 3a of the side-guides 3 between the rollers 2 to break off.

Figure 2:
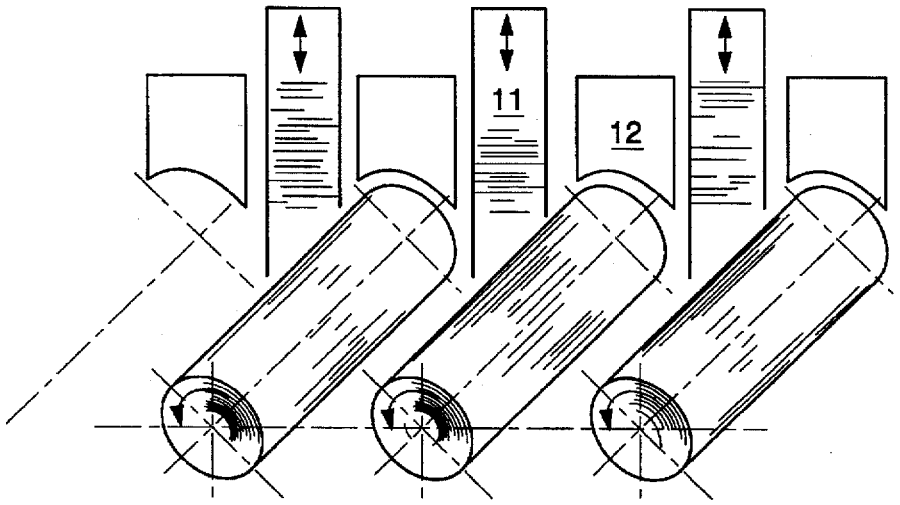
FIG. 2 is a similar view as FIG. 1 in accordance with the solution proposed by the present invention.
Figure 3:
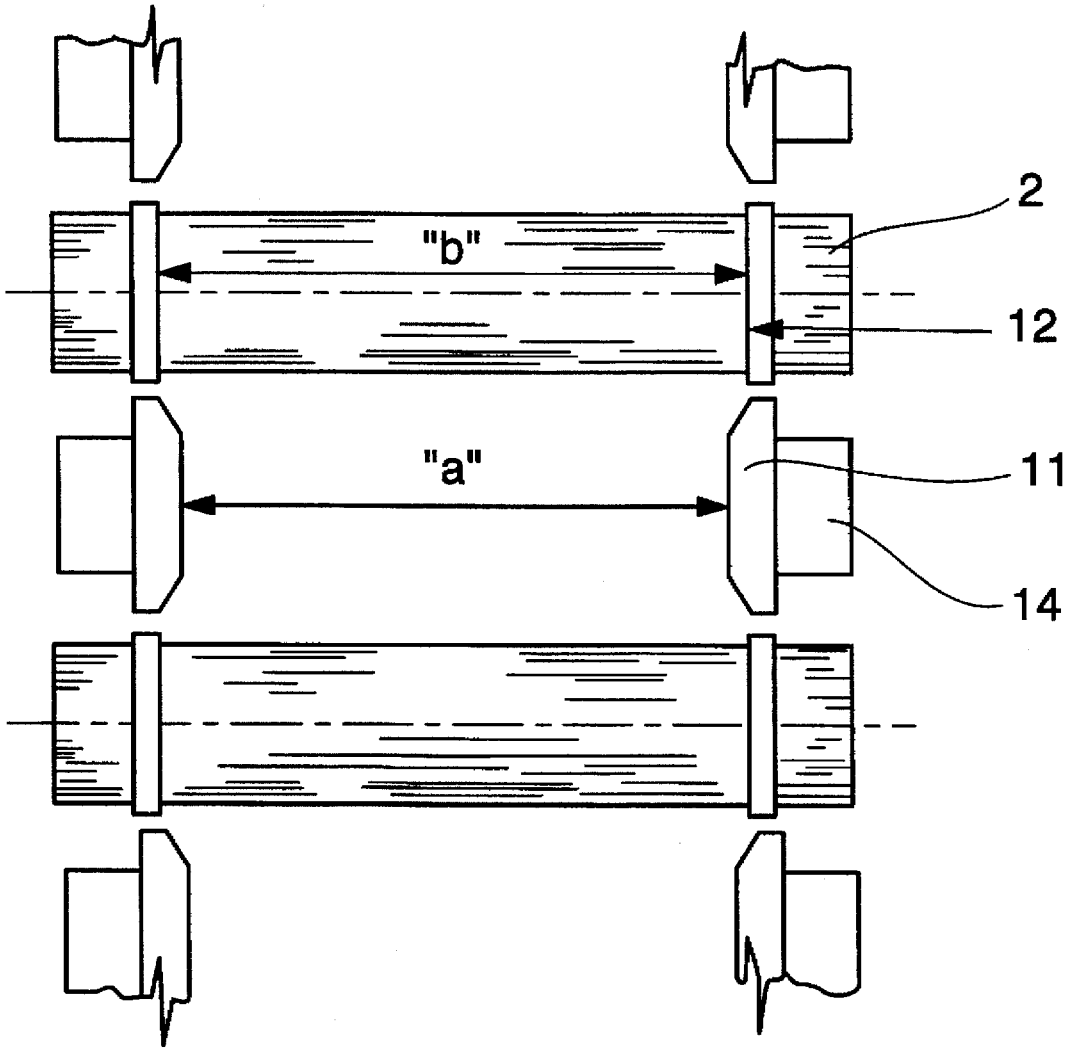
FIG. 3 is a top plane view corresponding to FIG. 2 which is mainly intended to illustrate the offset position oft he segments of the represented side-guides.

In order to increase their life-span the side-guides of the present invention are divided in a succession of segments in an alternation of a first segment 11 of a substantially rectangular shape and having a width allowing its insertion between two rollers 2 and a second segment 12 intended to be placed above a roller 2, of which the lower end is of substantially semicircular shape. FIG. 2 and 3 represent an alternation of three "first" segments 11 and four "second" segments 12.

Furthermore, as is more apparent from FIG. 3 where the two side-guides 3 are each represented as segmented and made of an alternation of the said first segments 11 and second segments 12 which are shown, the said first segments 11 are slightly offset compared to the plane formed by the said second segments 12. In other words, the spacing "a" between two opposite first segments 11 is smaller than the spacing "b" between two opposite second segments 12.

Thus, the first segments 11 will be submitted to a rather intensive wear while the second segments 12 will only be occasionally subjected to wear.

The first segments 11 at least, are vertically adjustable in such a manner that without disassembling, the friction spots can be moved from the first line of wear to a further zone of the corresponding segment of the side-guide.

When the full surface made out of successive lines of wear cover the whole surface of the segments of the side-guides, then only disassembling is required and after wear-out these segments then have to be replaced or at least repaired.

Any suitable device which in the drawings is illustrated schematically by reference numeral 14, may be used to control the vertical movements of the segments 11.

A device suitable for the purpose may be rather simple such as rack-bar or similar. It may even be electrically or hydraulically driven.

In a hot rolling mill having a current production rate of 3,000,000 ton/year and having a quick roll change in the finishing mill and using 3 downcoilers, the welding of the former type, compared to the price of the parts 11, resulted in a saving of U.S. $ 20,000 each year. A greater advantage is seen on the shut-down periods needed for changing the side guides: between 1 and 2 hours extra-unplanned shut-down was needed each month for changing the wear plates.

The new type can last a whole production period (2 to 3 weeks) so they only have to be changed on planned maintenance shut-downs.

What is claimed is:

1. Side guides intended for rolling mills in the metallurgical industry, in which a strip is conveyed onto a series of rollers wherein said side-guides are divided in a succession of segments which are placed in an alternation of first and second segments;

said first segments of a substantially rectangular shape and having a width allowing insertion between two successive rollers said second segments intended to be placed above a corresponding roller, said second segments each having a lower end of substantially semicircular shape, said first segments between rollers being slightly offset compared to a vertical plane formed by the second segments above the rollers;

wherein spacing between two opposite first segments placed between the rollers is smaller than spacing between two opposite second segments placed above the rollers.

2. Side guides according to claim 1, wherein contact between said strip and said side guides marks a line of wear at a friction spot, characterized in that at least the segments between the rollers are vertically adjustable in such a manner that when the friction spot shows substantial wear, a vertical movement under the control of a central device requiring no disassembling of the rolling mill allows further operation of the rolling mill.

* * * * *